United States Patent [19]

Brown

[11] 4,357,676

[45] Nov. 2, 1982

[54] FREQUENCY MULTIPLEXED JOINT TRANSFORM CORRELATOR SYSTEM

[75] Inventor: Hugh B. Brown, Fremont, Calif.

[73] Assignee: Ampex Corporation, Redwood City, Calif.

[21] Appl. No.: 185,053

[22] Filed: Sep. 8, 1980

[51] Int. Cl.[3] ..... G06G 9/00

[52] U.S. Cl. ..... 364/822; 350/162 SF; 356/345

[58] Field of Search ..... 356/349, 353, 354, 345, 356/347; 364/822; 350/162 SF

[56] References Cited

PUBLICATIONS

Casasent, David, *Coherent Optical Pattern Recognition,* Proc. of the IEEE, Vol. 67, No. 5, May 1979, pp. 813–825.

Lee, T. C. et al., *Dual-Axis Joint Fourier Transform Correlator,* Optics Letters, Vol. 4, No. 4, Apr. 1979, pp. 121–123.

David Casasent et al., *New Transformation for Optical Signal Processing,* Optics Communications, Vol. 19, No. 2, Nov. 1976, pp. 212–216.

Casasent, D. et al., "Equalizing and Coherence Measure Correlators", Applied Optics, Vol. 17, No. 21, 11/1/78, pp. 3418–3423.

*Primary Examiner*—Bruce Y. Arnold

*Attorney, Agent, or Firm*—George B Almeida; Joel D. Talcott

[57] ABSTRACT

An improved joint transform correlator system frequency multiplexes two input signals to reduce the resolution along a single optical axis by one half, and uses full input transducer resolution in the other axis to provide a 20% increase in overall system performance. The two input channels are combined by summing baseband channel 1 information with reference channel 2 information which is frequency shifted using single sideband modulation techniques. The resultant signal is used to drive an input transducer of an optical system. The input transducer spatially modulates the light from a laser. A frequency plane is produced by the input optics, where the spatially separated channels may be observed. An interferometer is used to further process the signal information by combining the two channels at the joint transform plane. The combined signals are then written onto an optical-to-optical transducer where the joint transforms are multiplied together through a detection process. The output of this transducer is transformed by the output optics system to provide the cross correlation plane to an output transducer.

8 Claims, 9 Drawing Figures

FREQUENCY MULTIPLEXED JOINT TRANSFORM CORRELATOR SYSTEM

The invention described herein was made in the course of Contract No. MDA904-78-C-0553 awarded by the United States Government.

BACKGROUND OF THE INVENTION

The invention relates to joint transform correlators and particularly to a joint transform correlator employing an interferometer, and a data formatting system using frequency multiplexing techniques.

Optical joint transform correlators used for real time applications employ two spatially separated images written onto the input transducer. Systems not used for real time use film images separated spatially at the input, or an image at the input and a holographic matched filter at the transform plane.

A joint transform correlator using two spatially separated input images has real time applications since the images can be written onto a spatial light modulator (SLM). The input images are then illuminated by a collimated coherent light source. The spatially modulated light is then passed through a lens to produce the joint transform plane. Since the input images are spatially separated, and the light from each image passes through the transform plane with a given angular relationship, interference fringes are produced. This process optically introduces a carrier to the cross correlation products. To complete the correlation process it is necessary to multiply all of the cross terms from each of the input images. The multiplication is accomplished by using an optical detection process, such as recording the joint transform on film (a non-linear detection media) or, for real time operation, the joint transform can be written onto an optical-to-optical transducer such as a liquid crystal light valve. The output of the second transducer is then transformed optically to produce the correlation plane. Since a carrier is introduced by spatially separating the input images, the cross correlation output is spatially separated from auto correlation and other undesired outputs produced by the optical system.

Under real time conditions, such a prior art correlator system requires a complete input system. Generally the spatial light modulators used in the system have a single input port. Thus, in order to receive the two spatially separated input images, the system must employ a digital data formatting system that further includes a significant high speed memory system with proper digital support. If the input images contain broadband signal information in analog format, high speed digitation is also required. Thus, such prior art correlator systems require relatively complex digital input circuits, and do not make efficient use of the area space bandwidth product of the spatial light modulator, i.e., of the input transducer.

A second prior art correlation system employs two separate light transducers which require extensive optical and electrical matching that generally is cost prohibitive in producing a high time bandwidth correlation system.

The above prior art joint transform correlator, using spatially separated input images, has a time bandwidth product equal to one third of the time bandwidth product of the input transducer, since the input image covers one third of the transducer's area. On the other hand, the frequency multiplexed joint transform system of description herein has one half the time bandwidth product of the input transducer, since the entire transducer area is used, at one half the bandwidth.

Thus, the invention correlator system extends the time bandwidth product of the joint transform correlator system, while also eliminating the need to data format with a complex digital system. The frequency multiplexed joint transform correlator system allows each channel to use the entire scanned area of the input transducer while each channel occupies one half of the total allowable bandwidth. This system thus allows the input transducer to be used more efficiently.

A typical prior art cross correlator system employing two spatially separated input images is shown in the article by D. Casasent, Proceeding of the IEEE, Vol. 67, No. 5, May 1979, pages 813–825. A prior art system employing two input transducers and a dual-axis configuration is depicted in the article by T. C. Lee et al, Optics Letters, Vol. 4, No. 4, Apr. 1979, pages 121–123. Still another prior art correlator system employs a form of signal multiplexing at the input thereto, but which further employs electronic means (i.e., a modified spectrum analyzer) not optical means, to process the joint transform correlator output. Such a system is depicted in the article by D. Casasent, et al, Applied Optics, Vol. 17, No. 21, Nov. 1, 1978, pages 3418–3423.

SUMMARY OF THE INVENTION

The invention provides the improved correlator system by means of a pre-processed input signal via a frequency multiplexing technique, and by then performing an optical joint transform process via interferometeric means. Thus the correlator system frequency multiplexes the input information (images, signals) with a reference matched input to allow subsequently optically overlapping the two channels at a predetermined interference angle, via the selected carrier frequency and the interferometer. This method provides the necessary optical carrier that results in the separation of the cross correlation terms from auto correlation terms at the system output.

To this end, the two channels of information are fed to a data channel mixer circuit which provides a frequency multiplexed input to the optical processing system. The first channel of information is summed with a second channel that has been processed through a single sideband suppressed carrier modulator. The summed input is fed to an electrical-to-optical input transducer such as a coherent light valve, which is illuminated by a coherent light source. The two channels are spatially separated at the first frequency plane, whereby the interferometer means is used to produce overlapping data channels at the second frequency plane (joint transform plane). The resulting interference of data that cross correlates, produces an optical carrier in the form of interference fringes that may be written onto film, or onto an optical-to-optical transducer for real time operation. Due to nonlinear characteristics of the film media or of the optical-to-optical transducer used in the process, the joint transforms are multiplied together producing autocorrelation and crosscorrelation products. The cross correlation products are on a carrier produced by the interference angle introduced by the interferometer, and become spatially separated at the system output.

Readout is accomplished by illuminating the film, or the output of the optical-to-optical transducer, with a coherent light source, and transforming the multiplied joint transform information via a lens to provide the cross correlation products at the corresponding correlation plane.

DESCRIPTION OF THE PREFERRED EMBODIMENTS

Figure 1:
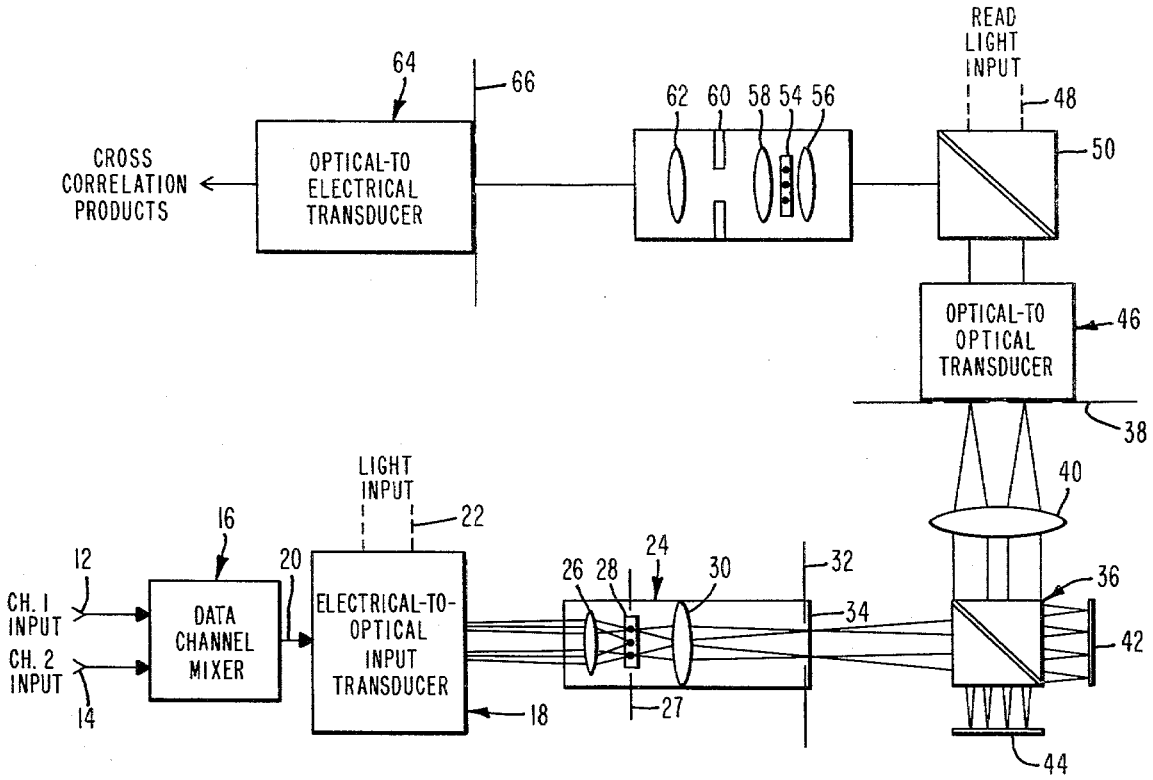
FIG. 1 is a block diagram of a frequency multiplexed joint transform correlator (JTC) system of the invention.

Referring to FIG. 1, there is depicted a complete cross correlator system in which the invention forms an integral part. To this end, two channels of information corresponding, for example, to a reference signal and an information signal which is to be cross correlated with the reference signal, are introduced at inputs 12, 14, to a data channel mixer circuit 16. The latter supplies a selectively summed signal, which defines a pair of frequency multiplexed signals, to an electrical-to-optical input transducer 18 such as a coherent light valve, via a line 20. The input transducer 18 conventionally is illuminated, for example, by a coherent light beam input at 22. The light input 22 is spatially modulated at the input transducer 18 by the input signal thereto on line 20, to provide two channels of spatially separated optical signals, which are fed to input optic means 24. The optical signals each are formed over the full input aperture of the input transducer 18, i.e., in the time plane. This in turn eliminates the need for digital data formating, as is necessary in previous systems using two spatially separated signals over two input apertures of the input transducer, when operating in real time.

The frequency multiplex input to the input transducer 18 is applied to the input optic means 24, which perform generally conventional beam processing. More particularly, the spatially modulated light is transformed by a lens 26, which produces a Fourier transform at a first frequency plane 27 containing the two spatially separated signal channels. A spatial filter 28 is disposed at the first frequency plane 27, and removes the DC term; i.e., the zero order light terms. A lens 30 retransforms the signal information to produce a time plane (image) 32 at a spatial filter 34, which is used to remove the sinc function produced by the input aperture at the input transducer 18.

The processed light beam from the input optic means 24, is applied to an interferometer means 36, which introduces an angular displacement resulting in an interference angle between the two channels of information at a frequency plane 38. The interferometer means 36 thus interferes the frequency planes produced by the two input channels, where the angular relationships for proper interference are introduced via mirrors 42, 44. An optical-to-optical transducer means 46 such as, for example, a liquid crystal light valve, a photographic film, etc., is disposed at the transform plane 38, whereby the joint transform may be multiplied and stored. In a real time system, the liquid crystal light valve is preferred since it is fast acting, efficient and reliable.

In the read process, the optical-to-optical transducer 46 is illuminated by a read coherent light beam 48 via a polarized beam splitter 50, which is used in conjunction with the light valve 46 as an analyzer. The spatially modulated light from the transducer 46 is applied to generally conventional read optic means, which perform beam processing in a manner of the prior input optic means 24. More particularly, the light beam is filtered at a fourier transform plane produced by a lens 56 at the spatial filter 54, to filter the DC term. A lens 58 retransforms the light onto a spatial filter 60, where the sinc function introduced by the input aperture of the optical-to-optical transducer 46 is filtered. A final lens 62 retransforms the light onto a optical-to-electrical transducer 64, such as a vidicon camera, at the resulting cross correlation plane 66. The vidicon camera generates an electrical output of the system cross correlation products.

Figure 2:
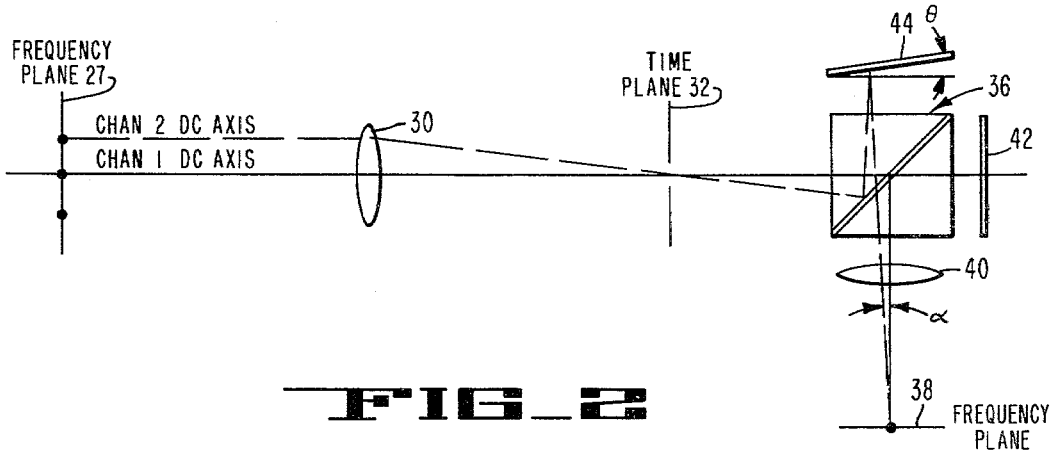
FIG. 2 is an optical block diagram of the frequency multiplexed JTC system of FIG. 1.
Figure 3:
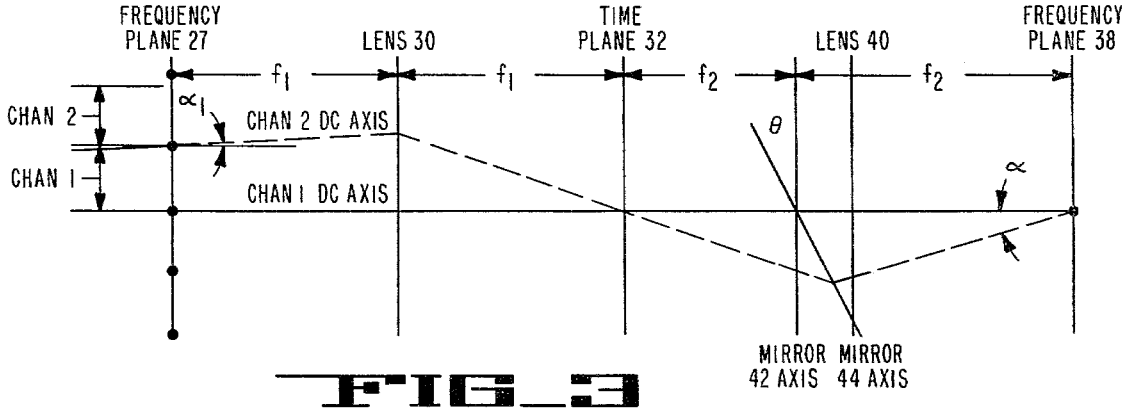
FIG. 3 is an optical ray trace diagram of the frequency multiplexed JTC system of FIGS. 1 and 2.

FIGS. 2 and 3 depict a ray trace diagram respectively, of the frequency multiplexed joint transform correlator system of FIG. 1. Similar components are similarly numbered in the FIGS. Thus two optical input channels from the input transducer 18 are spatially separated at the frequency plane 27 corresponding to the spatial filter 28. The basic image lenses include the lens 30 and lens 40 which image the input transform plane at the frequency plane 38, corresponding to the transform plane at the input to the optical-to-optical transducer 46. The interferometer means 36 produces an angular displacement, i.e., the interference angle $\alpha$, between the channels at the frequency plane 38. The resulting interference fringes optically introduce a carrier to the cross correlation terms. The joint transform is subsequently read out to generate the correlation plane 66 at the optical-to-electrical transducer 64.

FIG. 3 depicts the image lenses 30, 40 and the interferometer means 36, and shows the interference angle introduced to the channels by the mirrors 42, 44 thereof. More particularly, mirror 44 of channel 2 is offset an angle $\theta$ (FIGS. 2 and 3) to provide the interference angle $\alpha$ between the channels at the joint transform plane 38, and thus the overlapping of the transforms as further depicted in FIG. 5A–5E.

Figure 4:
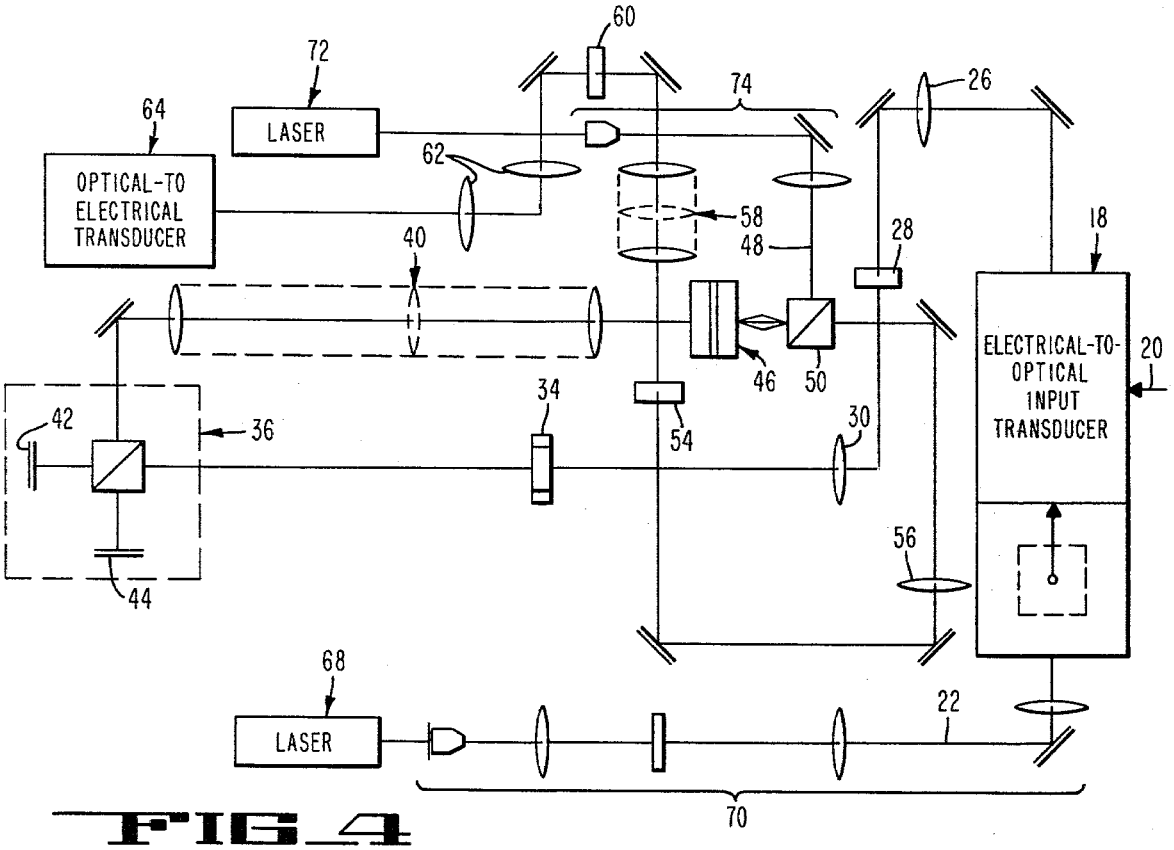
FIG. 4 is an optical schematic diagram of the JTC system of FIGS. 1–3.

FIG. 4 depicts in greater detail an optical implementation of the system of FIG. 1, wherein similar components are similarly numbered. The various optical elements are shown in layout as disposed on an optical bench. Thus the frequency multiplexed input signals to the data channel mixer circuit 16 (FIG. 1) are fed to the electrical-to-optical input transducer 18 via line 20, while the transducer is illuminated via light input 22. The latter is provided via a laser 68 and is beam formed by generally conventional optical elements, e.g., objective lens, filter, etc, as at 70. The beam formed light is then spatially modulated by the input transducer which, by way of example only, may be a coherent light valve such as manufactured by General Electric Company, which herein handles a frequency bandwidth of the order of 20 MHz. In this example, the first channel input bandwidth is from DC to 10 MHz, while the second channel input bandwidth is from 10 to 20 MHz. The corresponding spatial response on the light valve 18 is from zero to 22 cycles/millimeter (mm) for channel one, and 22 to 44 cycles/mm for channel two.

The spatially modulated light is then fed to the input optic means 24 defined by the elements 26–34, which process the light as described in FIG. 1. The optical information is then passed through the interferometer means 3 where the two channels are combined at the joint transform plane by offsetting one of the mirrors thereof, e.g., mirror 44 of channel 2. This provides the interference angle between the channels as depicted in FIGS. 2, 3. The resulting light, containing the interference fringes, is transformed via the lens (pair) 40 at the frequency plane 38 corresponding to the input to the optical-to-optical transducer 46.

The transducer 46, by way of example only, preferably is a Hughes liquid crystal light valve having a spatial response greater than 10 cycles/mm. The light valve 46 provides the multiplication and storage functions that are necessary to produce a correlation output, in response to the usual AC bias thereto. The joint transform that is written onto the light valve is multiplied using the detection process inherent in the device. By way of example only, the interferometer means 36 preferably is a Michelson interferometer, generally known in the art. However, other optical apparatus may be used as further discussed in FIGS. 7–9.

As exemplified herein, a signal originating at the center of the input aperture of the input transducer 18, representing the DC terms of each channel, will produce a Fourier transform at the spatial filter 28, having a single quadrant dimension of 3.5 millimeters square ($mm^2$). This transform is imaged onto the liquid crystal light valve 46 through the lens 30 and the lens pair 40. A magnification ratio of 2.2:1 results in a single quadrant transform size at the light valve 46 of 7.78 $mm^2$. When the interferometer means 36 is placed 1016 mm from the light valve 46, and is adjusted to overlap the two channels of information, it produces interference fringes of the cross correlatable information of approximately 7 cycles/mm to approximately 20 cycles/mm.

In the readout process of the joint transform, the liquid crystal light valve 46 is illuminated via the read light input 48 which is generated by a laser 72, and is beam formed via optical elements 74 in the manner of the light input 22. The output of light valve 46 is processed by the read optic means 52 formed of the lens 56, spatial filter 54, lens (pair) 58, spatial filter 60 and the lens (pair) 62, as described in FIG. 1. The lens 56 produces the Fourier transform at filter 54, which is imaged onto the optical-to-electrical transducer 64 via lenses 58, 62. The transducer 54 utilized herein is a vidicon camera which detects the correlation plane and thus the cross correlation products of the initial input signals 12, 14.

Figure 5:
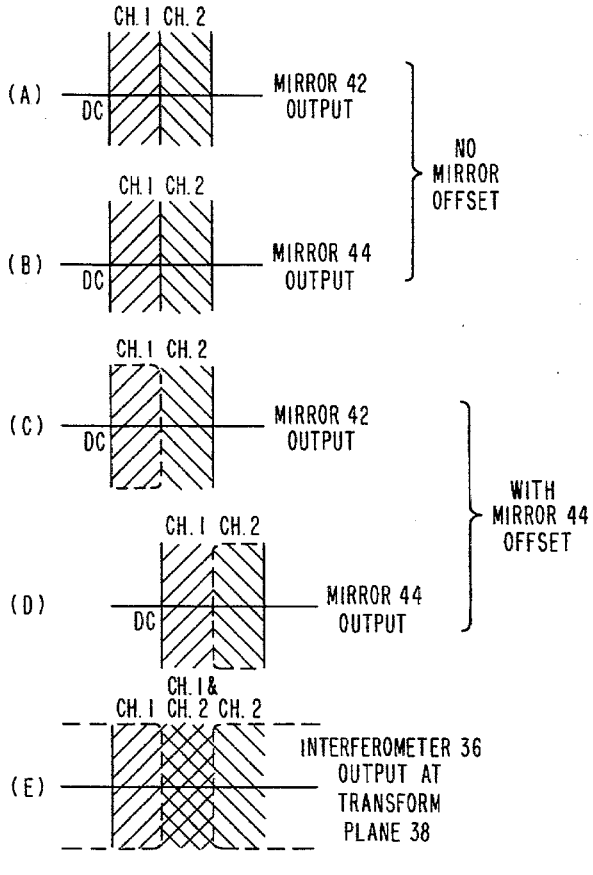
FIG. 5A–5E is a graph depicting the output transform of the interferometer without and with, respectively, an offset applied to the mirror of one of the channels of the interferometer.

FIG. 5A–5E are graphs depicting the frequency spectra of the two optical channels of information as affected by the interferometer means 36, and how the latter is used to interfere the channels, as best depicted in prior FIG. 2. The frequency spectra of channels 1 and 2 relative to the DC term are shown in FIG. 5A and 5B respectively. With no offset on either mirror 42, 44, i.e., with the interferometer operating in its usual fashion, the resulting transforms of the channel 1 and 2 information, i.e., the frequency spectra, as reflected from the mirrors 42, 44 respectively, are perfectly overlapped. That is, channel 1 information from mirror 42 overlaps channel 1 information from mirror 44, and channel 2 information from mirror 42 overlaps that of channel 2 from mirror 44. Thus there is no overlapping of channels 1 and 2. To provide overlapping and thus the desired correlator operation, the mirrors are offset at an angle corresponding to the channel displacement at the frequency plane. Thus, mirror 44 is purposely offset to provide the interference angle, which displaces the frequency spectra as seen at the subsequent transform plane 38, FIG. 5E, such that channel 1 information from the mirror 44 exactly overlaps the channel 2 information from the mirror 42. Pictured in FIGS. 5C and 5D are the optical transforms for mirrors 42 and 44 respectively. Using a spatial filter at the joint transform plane, channel 1 from mirror 42 and channel 2 from mirror 44 are filtered out, and channel 1 from mirror 44 and channel 2 from mirror 44 form the joint transform plane. Thus, as shown in FIG. 5E, the output of the interferometer means 36 in the transform plane 38, is formed by channel 1 and channel 2 information in perfect alignment at the given interference angle.

Figure 6:
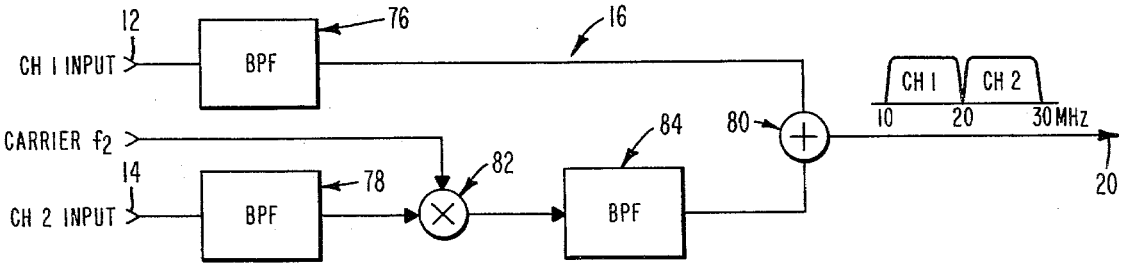
FIG. 6 is a block diagram of the data channel mixer electronics which performs the frequency multiplexing of the input signals.

FIG. 6 is a block diagram of the data channel mixer circuit 16 of FIG. 1, wherein the input channels 1 and 2 are applied to respective bandpass filters 76 and 78 via the inputs 12 and 14 respectively. The input signals may be derived from any of various sources, e.g., an electron beam recorder, video recorder, etc. In the example herein, the recorded signal has a bandwidth of 20 MHz and is fed directly from the bandpass filter 76 to a summing junction 80. The channel 2 signal is filtered by bandpass filter 78 and is mixed at a mixer circuit 82 with a carrier $f_2$ of, for example, 20 MHz. The resulting suppressed carrier double sideband signal is fed to a bandpass filter 84 which selects the upper sideband of 20 to 30 MHz. The latter signal is fed to the summing junction 80, and is added to the 10 to 20 MHz signal of channel 1. This provides a dual channel electrical signal input with bandwidths of 10 to 20 MHz and 20 to 30 MHz respectively, as depicted at the output line 20 of FIG. 6. These inputs may be supplied via a suitable recorder, or may be supplied from the data channel mixer 16 to the input transducer 18, as depicted in FIG. 1. Of course, the input transducer 18 must have an input bandwidth which accomodates that of the combined input signals.

Figure 7:
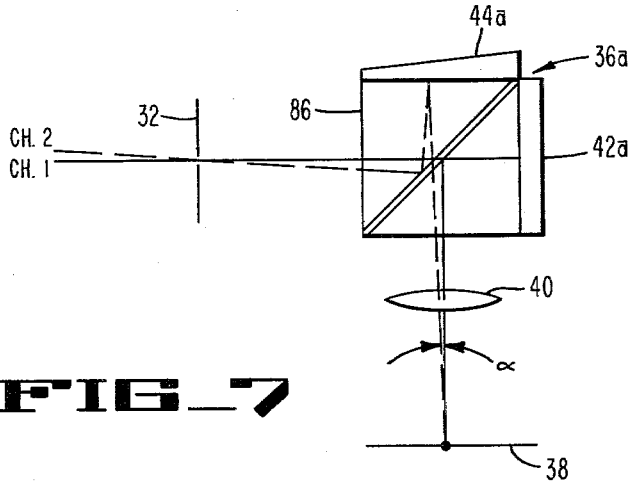
FIGS. 7, 8, and 9 are optical block diagrams depicting alternate apparatus for performing the interferometer technique of optically overlapping the input channels.
Figure 8:
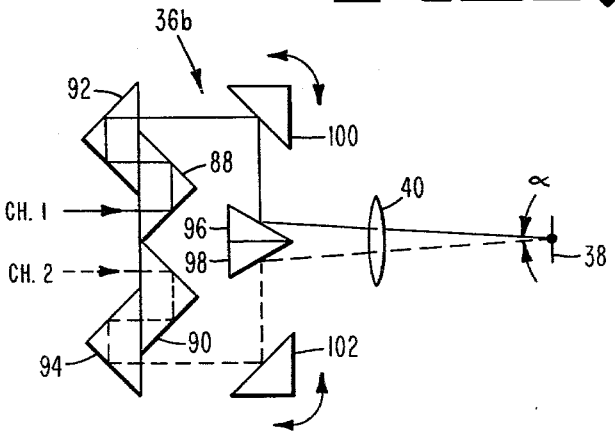
Figure 9:
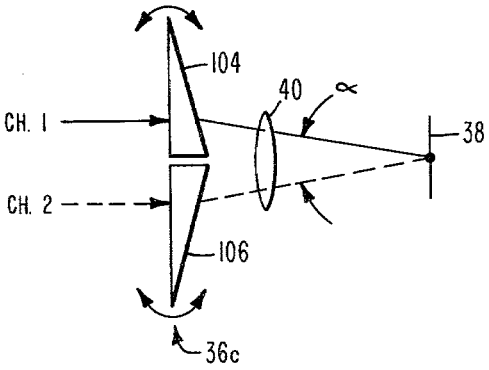

FIG. 7, 8 and 9 depict alternative interferometer apparatus for providing the interference of the two spatially separated transforms of channels 1 and 2, derived from the input transducer 18. Thus FIG. 7 depicts a fixed, rigid version **36*a* of the Michelson interferometer (means 36) of previous mention, wherein a beam splitter 86 similar to that of the previous FIGURES has a mirror 42*a* bonded thereto. A mirror 44*a* having a selected fixed angle corresponding to the offset of the mirror 44 of the previous FIGURES, is bonded to the respective surface of the splitter 86**, and provides the required interference angle $\alpha$. Such a fixed interferometer means is advantageous since it is less susceptable to vibration and other associated problems.

FIG. 8 depicts an interferometer means **36*b* wherein the channels 1 and 2 are introduced, with a parallel relationship, to a first pair of optical prisms 88, 90 and thence to a second pair of prisms 92, 94 respectively. The beams are then fed to optical wedges 96, 98 via respective pivotable wedges 100, 102. The beams are then applied to the transform lens (pair) 40 of previous description, to provide the joint transform plane 38. Rotation of the wedges 100, and 102 (or wedges 96, 98**)

provides the required adjustment for proper system alignment.

FIG. 9 depicts a simplified interferometer means 36c wherein the channels 1 and 2 of information are applied (in a parallel relationship) to a pair of pivotable optical wedges 104, 106. The positions of the wedges are adjusted via the lens 40 to provide the required interference angle at the transform plane 38. The wedges 104, 106 may be designed with the desired angle, and then are fixed in the optical layout in proper alignment.

What is claimed is:

1. A joint transform correlator system including means for providing the joint transform and means for providing the cross correlation products of a first and second channel of information, comprising the combination of:

channel mixer means for carrier modulating and filtering one channel of information and for adding the carrier modulated and filtered information to the other channel of information;

electrical-to-optical input transducer means for receiving the summed channels of information and for providing spatially separated channels of information; and interferometer means disposed to interfere said spatially separated channels of information to produce the joint transform at a joint transform plane.

2. The system of claim 1 including optical-to-optical transducer means for storing the joint transform for readout of the cross correlation products.

3. The system of claim 2 wherein:

the interferometer means is a Michelson type interferometer having two adjustable mirrors; and one of the adjustable mirrors is adjusted to provide an optical axis offset to the incoming light beam.

4. The system of claim 2 wherein:

the interferometer means includes a pair of optical wedges of selected optical refractive angle, said wedges disposed to receive the channels of information and to impart a selected angle between the channels at the transform plane.

5. The system of claim 2 wherein the interferometer means includes a plurality of pairs of optical prisms disposed to receive the two channels and to re-direct the two light beams thereof; and optical wedge means, including a pair of pivotable optical wedges, disposed to receive the redirected light beams and to form an interference pattern between the beams which beams are incident at a selected angle at the transform plane.

6. The system of claim 2 wherein: the electrical-to-optical input transducer means includes an input aperture;

a coherent light source illuminates the input aperture; and there is provided input optic means, including spatial filters and transform lens means, for generating the joint transform plane.

7. The system of claim 6 further including:

readout electro-optical means, including a coherent light source, for spatially modulating the recording means and for generating a cross correlation plane; and optical-to-electrical transducer means disposed at the cross correlation plane for detecting the cross correlation product.

8. A joint transform correlator system including means for providing the joint transform and means for providing the cross correlation products of a first and second channel of information comprising the combination of:

input electro-optical means including an electrical-to-optical transducer means having an optical input aperture for receiving each channel of information over the full input aperture, with each channel at $\frac{1}{2}$ the total bandwidth, and for providing spatially separated channels of information; and interferometer means disposed to interfere said spatially separated channels of information to produce the joint transform at a subsequent joint transform plane.

* * * * *